United States Patent [19]

Cleveland

[11] 4,183,494

[45] Jan. 15, 1980

[54] SWIVELED LEAF-SPRING UNDERCARRIAGE FOR ROCKING CHAIR

[75] Inventor: Robert M. Cleveland, Chicago, Ill.

[73] Assignee: Trendler Metal Products, Inc., Chicago, Ill.

[21] Appl. No.: 959,467

[22] Filed: Nov. 13, 1978

[51] Int. Cl.[2] ..... A47C 3/02

[52] U.S. Cl. ..... 248/628; 297/264; 248/567

[58] Field of Search ..... 248/580, 582, 583, 567, 248/603, 604, 626, 628, 625; 297/264, 265, 268, 314

[56] References Cited

U.S. PATENT DOCUMENTS

| | | | |
|---|---|---|---|
| 762,381 | 6/1904 | Bruce | 248/625 |
| 1,762,788 | 6/1930 | Noelle | 248/628 |
| 2,913,038 | 11/1959 | McDerby | 248/628 |
| 2,916,084 | 12/1959 | Bottemiller et al. | 248/625 |
| 3,013,764 | 12/1961 | Kuhn | 248/628 |
| 4,119,343 | 10/1978 | Pentzien | 297/268 |

FOREIGN PATENT DOCUMENTS

| | | | |
|---|---|---|---|
| 665411 | 6/1963 | Canada | 248/580 |

*Primary Examiner*—Francis K. Zugel
*Attorney, Agent, or Firm*—Rummler and Snow

[57] ABSTRACT

A leaf-spring supported, free-floating rocker undercarriage for a swivel chair wherein the spring flexural axis corresponds to and the swivel axis intersects with the rocking axis of the chair for support of the same.

2 Claims, 5 Drawing Figures

SWIVELED LEAF-SPRING UNDERCARRIAGE FOR ROCKING CHAIR

BACKGROUND OF THE INVENTION

Rocking chairs include spring-supported, rocker-supported and pivot-supported types. The rocker-supported chair is traditional. The pivot-supported chair is cheap. Neither economically offers vertical cusion in the support of the chair with sidewise tilt although both provide lateral stability of the same.

There is an established need for an undercarriage for swiveled rocking chairs having vertical cushion with sidewise tilt in addition to lateral stability in the support of the chair.

SUMMARY OF THE INVENTION

The gist of this invention lies in a free-floating undercarriage for a swivel chair comprising a plurality of U-shaped leaf-springs made of flat stock having their flexural axes arranged in coincidental relation to the rocking axis and intersecting the swivel axis of the chair, each spring alternately opening away from the rocking axis of the same, and being mounted between a free-floating plate and a swivel means in straddle-relation with respect to a sidewise-tilt axis for support of the chair on a footing below.

THE PREFERRED EMBODIMENT

Figure 1:
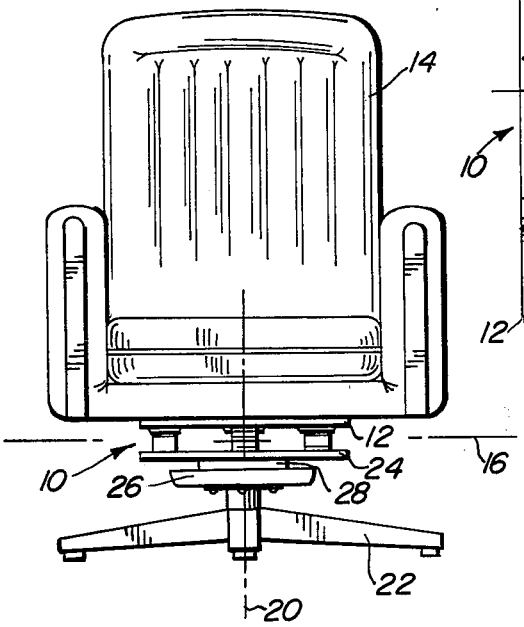
FIG. 1 shows a front elevation view of a swiveled rocking chair equipped with the invention.

Reference to FIG. 1 shows a swivel chair having an undercarriage 10 which comprises a free-floating tilting plate 12 attached to the under side of a chair 14 for rocking about a rocker axis 16 and tilting above a sidewise-tilt axis 18 in the horizontal plane while swiveling around a swivel axis 20 vertical thereto. A chair base 22 supports the chair on the floor surface and base plate 24 mounts on top of the same. A swivel mechanism 26 mounts between the base plate 24 and the chair base 22 in centered position on top of the same for concentric rotation in the horizontal plane thereon. The swivel mechanism 26 is of conventional type, having a swivel pin (not shown) rotatably mounted on and depending from a swivel plate 28 which bolts to the under side of base plate 24 and centers on swivel axis 20.

Figure 2:
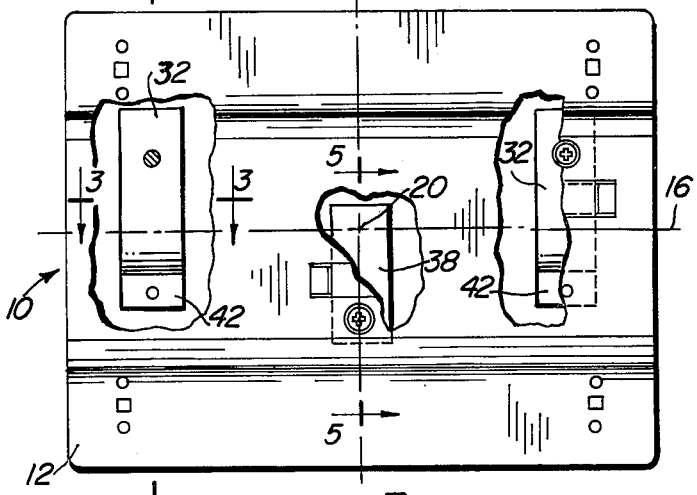
FIG. 2 shows a top plan view of the tilting plate of the same.
Figure 3:
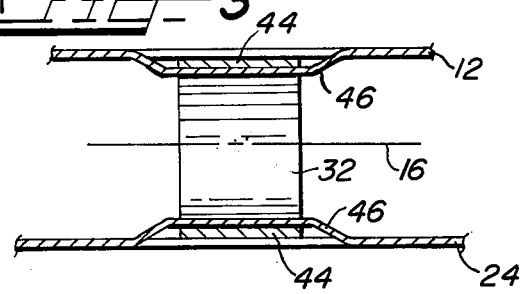
FIG. 3 is a fragmentary section taken along line 3—3 of FIG. 2 showing the manner by which the leaf-springs are attached to the upper and lower plates of the spring assembly.
Figure 4:
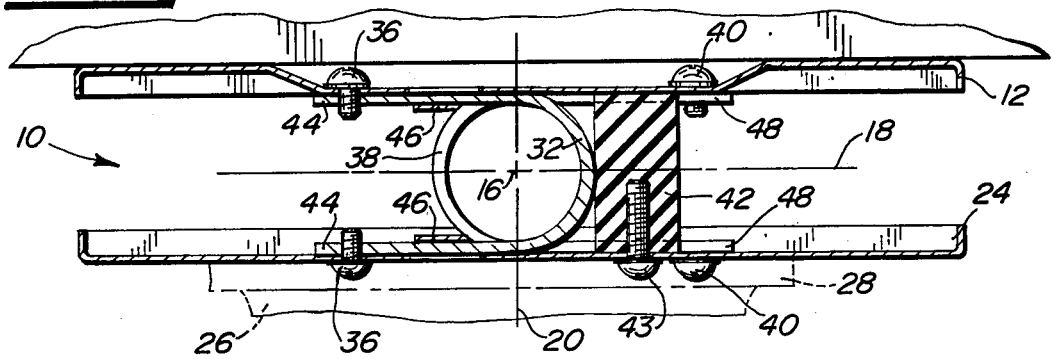
FIG. 4 shows a fragmentary section taken along line 4—4 of FIG. 2.

Reference to FIG. 2 shows two U-shaped leaf-springs 32 made of plate stock and adapted for flexure about an axis which centers on the semi-circular base of the "U", as shown in FIGS. 3 and 4, straddle-mounted by screws 36 to and about the sidewise-tilt axis 18 between free-floating tilting plate 12 and the base plate 24 having their open ends facing toward the back of the chair 14 with their flexural axes lying coincident with the rocker axis 16, as shown in FIG. 4.

Figure 5:
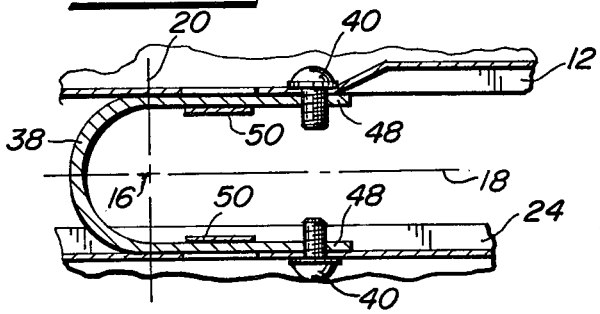
FIG. 5 shows a fragmentary section taken along line 5—5 of FIG. 2.

A single U-shaped leaf-spring 38 is mounted by screws 40 on the sidewise-tilt axis 18, between and on free-floating tilting plate 12 and base plate 24, with its open end facing toward the front of the chair 14 and with its flexural axis also lying coincident with the rocker axis 16, as shown in FIG. 5.

Rubber snubbers 42 are mounted with machine screws 43 on top of base plate 24 adjacent the forward end of each of lateral leaf-springs 32 for bumper contact with the bottom of the floating plate 12 and the snubbing of free oscillations of the chair undercarriage 10 under vertical loading thereon.

The legs 44 of U-springs 32 fasten to plates 12 and 24, respectively, with machine screws 36, and are further secured to the same by sliding insertion through shear-formed slots 46 punched in the wall of each plate, as shown in FIG. 3. Legs 48 of U-spring 38, which likewise fastens to plates 12 and 24 with machine screws 40, are also slidingly inserted under shear-formed slots 50 punched in each plate.

Although but one specific embodiment of this invention is herein shown and described, it will be understood that details of the construction shown may be altered or omitted without departing from the spirit of the invention as defined by the following claims.

I claim:

1. In a free-floating undercarriage for a chair having forward and backward rocking, sidewise-tilt and swivel axes, the combination with a swivel means comprising:

(a) a plurality of open-ended, U-shaped leaf-springs straddle-mounted between the chair and the swivel means on each side of the sidewise-tilting axis, each spring having its flexural axis in coincidental relation with the rocking axis of the chair and intersecting the swivel axis of the same and each spring having parallel legs opening in a direction facing rearwardly of the chair; and (b) a single open-ended, U-shaped leaf-spring likewise mounted between the chair and swivel means coincident with the sidewise-tilt axis of the chair having its flexural axis in like coincidental relation with the rocking axis of the chair and intersecting the swivel axis of the same and parallel legs opening in a direction facing forwardly of the chair.

2. In a chair having perpendicular axes for forward and backward rocking, sidewise-tilt and swivel intersecting at a common point, a tilting plate mounted on the under side of the chair, and a base plate mounted on a swivel means supported by the base of said chair, the improvement in mounting of said chair between the tilting plate and the base plate comprising an odd plurality of U-shaped leaf-springs having parallel legs forming open ends of the same, each leg mounting on one of each of said two plates, and each spring having its flexural axis coincident with the rocking axis of the chair and intersecting the swivel axis of the same, one spring of which lies on the sidewise-tilt axis of the chair with its open end directed forward, and the other springs of which straddle-mount said one spring with open ends directed rearward.

* * * * *